US011222617B1

(12) United States Patent
Hirasawa et al.

(10) Patent No.: US 11,222,617 B1
(45) Date of Patent: Jan. 11, 2022

(54) SNARE DRUM PRACTICE PAD

(71) Applicant: HOSHINO GAKKI CO., LTD., Aichi (JP)

(72) Inventors: Satoshi Hirasawa, Nagoya (JP); Atsushi Honjo, Nagoya (JP)

(73) Assignee: HOSHINO GAKKI CO., LTD., Aichi (JP)

( * ) Notice: Subject to any disclaimer, the term of this patent is extended or adjusted under 35 U.S.C. 154(b) by 0 days.

(21) Appl. No.: 17/178,150

(22) Filed: Feb. 17, 2021

(51) Int. Cl.
*G10D 13/03* (2020.01)

(52) U.S. Cl.
CPC ..... *G10D 13/03* (2020.02)

(58) Field of Classification Search
CPC ..... G10D 3/00; G10D 13/03; G10D 13/01
See application file for complete search history.

(56) References Cited

U.S. PATENT DOCUMENTS 6,239,340 B1 5/2001 Heuerman
2021/0142768 A1* 5/2021 Flipo ..... B62D 1/00

* cited by examiner

*Primary Examiner* — Kimberly R Lockett

(57) ABSTRACT

A snare pad includes a pad body, a batter surface member, and a dummy snare wire member. The batter surface member is coupled to the pad body. The dummy snare wire member is arranged in the pad body. The dummy snare wire member includes a plate-shaped first rigid member and a second rigid member that is arranged in a manner allowing for contact with the first rigid member. The batter surface member is coupled to the pad body without the pad body being located between the batter surface member and the dummy snare wire member.

12 Claims, 6 Drawing Sheets

SNARE DRUM PRACTICE PAD

BACKGROUND

1. Field

The following description relates to a practice pad for a snare drum.

2. Description of Related Art

A typical drum practice pad allows a user to practice playing the drum indoors. The drum practice pad is configured so that the user can practice playing the drum quietly without making the loud sounds produced when playing an acoustic drum. Accordingly, the practice pad needs to provide quietness in addition to a striking feeling that would be produced by an acoustic drum. In particular, a practice pad for a snare drum also needs to produce a sound resembling that of a snare wire when an acoustic drum is struck.

U.S. Pat. No. 6,239,340 discloses a snare drum practice pad (hereafter, snare pad) that includes a wooden pad body, a batter surface sheet formed from rubber, and a protection sheet formed from a sponge-like material. The batter surface sheet is applied to the upper surface of the pad body, and the protection sheet is applied to the lower surface of the pad body. The pad body includes a dummy snare wire member that produces a sound resembling that of a snare wire when the batter surface is struck.

The pad body includes a rectangular frame-shaped groove that is formed in the central region of the lower surface. The groove has a rectangular cross section. In the groove, a first metal plate and a second metal plate are fixed to each other by fastening bolts together with metal pellets. The first metal plate and the second metal plate have substantially the same shape and dimensions as the groove. The gap between the first metal plate and the second metal plate is filled with the pellets. The dummy snare wire member is formed by the first metal plate, the second metal plate, and the pellets held between the two metal plates.

When the batter surface sheet is struck with a stick, the impact of the strike is conveyed through the pad body to the dummy snare wire member. In this manner, in the dummy snare wire member, the pellets vibrate vertically between the first metal plate and the second metal plate and repetitively strike the first metal plate and the second metal plate. As a result, the sound produced when the pellets strike the first and second metal plates resembles the sound of a snare wire. As described above, the snare pad is configured to produce a sound resembling that of a snare wire when the batter surface sheet is struck.

In the snare pad disclosed in U.S. Pat. No. 6,239,340, the pad body, which is the main part of the snare pad, is arranged between the dummy snare wire member and the batter surface sheet. In this structure, the pad body has a tendency of absorbing a striking impact as the impact passes through the pad body when conveyed from the batter surface sheet to the dummy snare wire member. Accordingly, the striking impact may be weakened by the pad body before reaching the dummy snare wire member.

When the batter surface sheet is struck hard, the striking impact will be able to reach the dummy snare wire member and produce a snare wire resembling sound. However, when the batter surface sheet is struck gently, the striking impact may not be able to reach the dummy snare wire member, in which case a snare wire resembling sound will not be produced. In this manner, it is difficult to produce a low volume sound resembling that of a snare wire with the snare pad disclosed in the publication when the batter surface sheet is struck gently.

Further, in the snare pad disclosed in the publication, the batter surface sheet uses a sheet of hard rubber to limit impact absorption and convey a striking impact through the pad body to the dummy snare wire member. Although the striking impact is readily conveyed to the dummy snare wire member, the sheet of hard rubber cannot provide the striking feeling of an acoustic drum and cannot ensure quietness.

SUMMARY

One objective of the present disclosure is to provide a practice pad for a snare drum that readily reproduces a sound resembling that of a snare wire and the striking feel of an acoustic drum while ensuring quietness.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a snare drum practice pad is provided. The snare drum practice pad includes a pad body, a batter surface member, and a dummy snare wire member. The batter surface member is coupled to the pad body. The dummy snare wire member is arranged in the pad body to produce a sound resembling that of a snare wire when the batter surface member is struck. The dummy snare wire member includes a first rigid member and a second rigid member that is arranged in a manner allowing for contact with the first rigid member. Further, the dummy snare wire member is configured to produce the sound resembling that of a snare wire when the first rigid member and the second rigid member repetitively move in and out of contact with each other. The batter surface member is coupled to the pad body without the pad body being located between the batter surface member and the dummy snare wire member.

In another general aspect, a snare drum practice pad is provided. The snare drum practice pad includes a pad body, a hoop, a batter surface member, and a rim member. The pad body includes an open end. The hoop is fitted to an outer circumference of the open end. The batter surface member is coupled to the open end by the hoop and includes a drumhead that produces a striking feeling resembling that of a snare drum when the batter surface member is struck. The rim member is arranged on the pad body and extends along an outer circumference of the pad body. Further, the rim member is separate from the hoop.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An embodiment of a snare drum practice pad (hereafter, snare pad) in accordance with the present disclosure will now be described with reference to FIGS. 1 to 8C.

Figure 1:
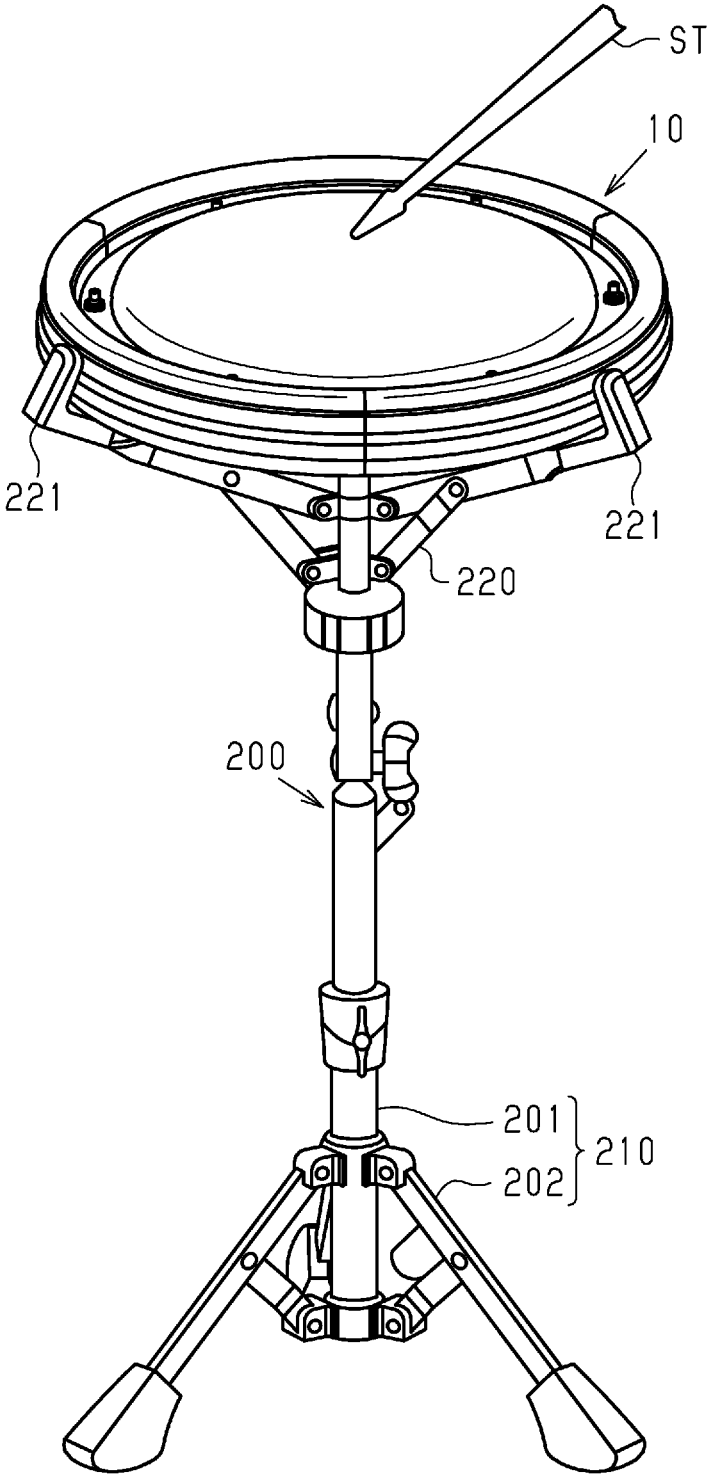
FIG. 1 is a perspective view of a snare pad in accordance with an embodiment of the present disclosure in a state mounted on a dedicated drum stand.

As shown in FIG. 1, a snare pad 10 is used in a state mounted on a dedicated drum stand 200. The drum stand 200 includes a stand main body 210 and a drum support body 220. The stand main body 210 includes a pole 201 and legs 202. The drum support body 220 includes arms 221 that hold the snare pad 10 or a snare drum (not shown). The snare pad 10 is fixed to the drum support body 220 by the arms 221 with a batter surface faced upward and is mounted on the drum stand 200. The batter surface is a surface struck by a stick ST, which serves as a striking member.

Figure 2:
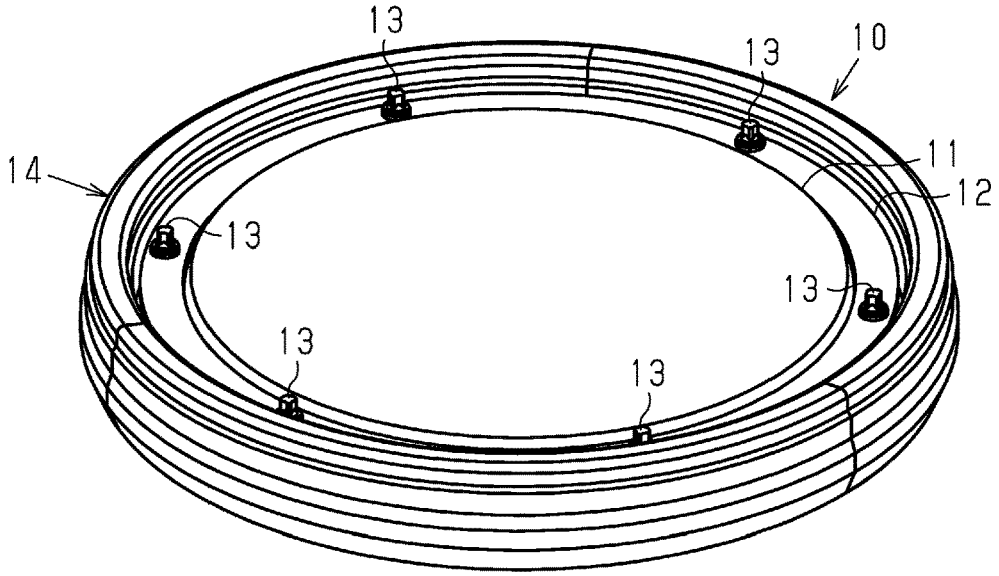
FIG. 2 is a perspective view of the snare pad.
Figure 3:
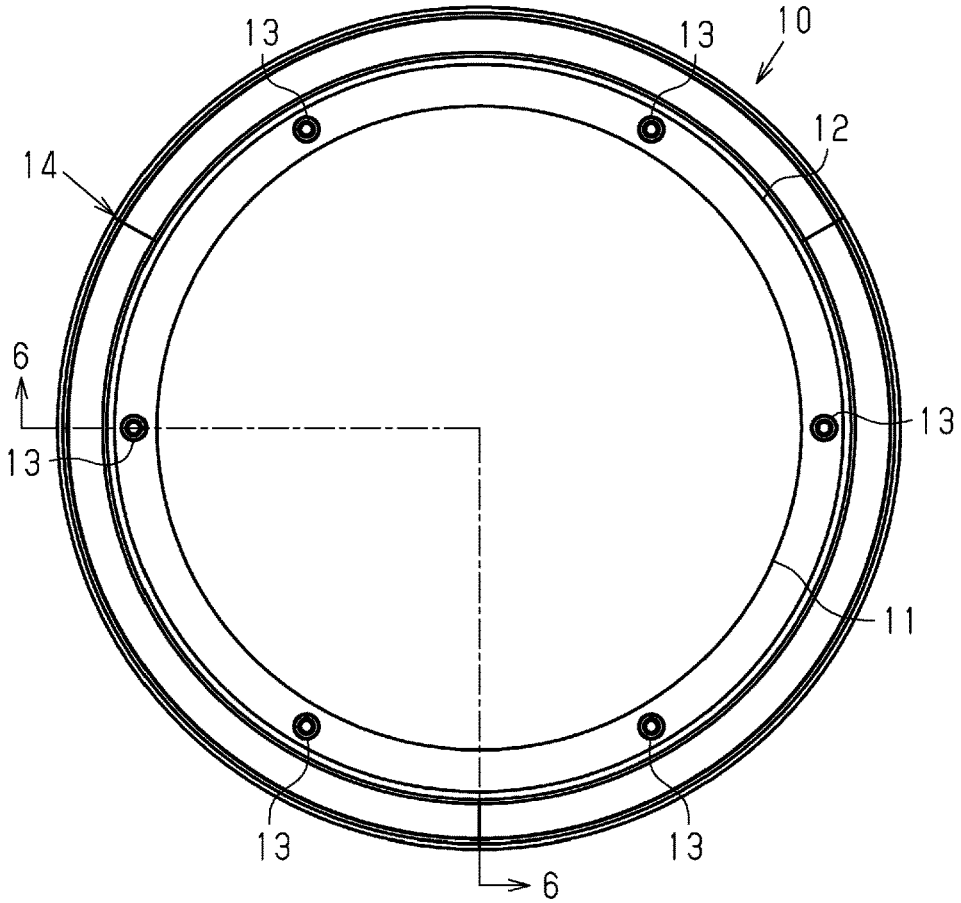
FIG. 3 is a plan view of the snare pad.

As shown in FIGS. 2 and 3, the snare pad 10 is substantially disc-like. The snare pad 10 may also be used in a state separated from the drum stand 200. For example, the snare pad 10 may be placed on a flat base or the lap of a user with the batter surface faced upward.

Figure 4:
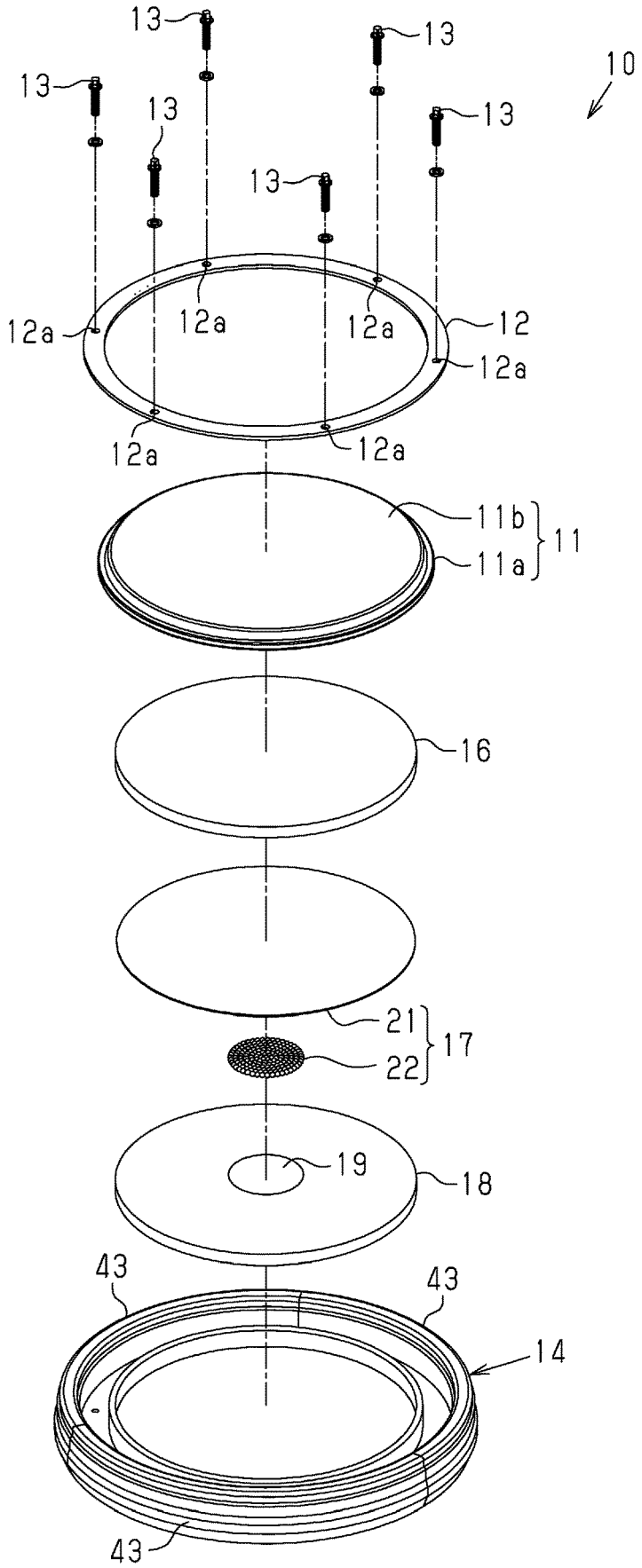
FIG. 4 is an exploded perspective view of the snare pad.

As shown in FIG. 4, the snare pad 10 includes a batter surface member 11, a hoop 12, a pad body 14, an upper elastic member 16, a dummy snare wire member 17, and a lower elastic member 18. The dummy snare wire member 17 includes a disc-shaped first rigid member 21 and second rigid members 22 that are arranged in a manner allowing for contact with the first rigid member 21. The snare pad 10 is formed by coaxially arranging the batter surface member 11, the hoop 12, the pad body 14, the upper elastic member 16, the first rigid member 21, and the lower elastic member 18 and coupling these parts integrally with one another.

The batter surface member 11 includes a frame 11*a* and a drumhead 11*b*. The frame 11*a* is a ring-shaped member that is fitted onto the outer circumference of an open end of the pad body 14. The frame 11*a* is formed from a metal material such as aluminum. The frame 11*a* has an outer diameter that is larger than the inner diameter of the hoop 12 and smaller than the outer diameter of the hoop 12. The frame 11*a* and the hoop 12 are configured to couple the batter surface member 11 to the pad body 14.

The drumhead 11*b* is a sheet-like member that is disposed to entirely cover the opening of the frame 11*a*. The drumhead 11*b* is formed by a sheet of a mesh material. The drumhead 11*b* is fixed to the entire inner circumference of the frame 11*a* and integrated with the frame 11*a*. When struck by the stick ST, which is shown in FIG. 1, the drumhead 11*b* provides a striking feeling resembling that of a snare drum.

The hoop 12 is a ring-shaped plate. The hoop 12 does not include a rim member and differs from hoop-integrated rim member. The hoop 12 includes six insertion holes 12*a* at equal angular intervals. A bolt 13 is inserted into each insertion hole 12*a* to couple the batter surface member 11 to the pad body 14.

The upper elastic member 16 and the lower elastic member 18 are disc-shaped sponge-like materials. The upper elastic member 16 is disposed between the batter surface member 11 and the dummy snare wire member 17 to prevent a striking impact from the drumhead 11*b* to be directly applied to the first rigid member 21 of the dummy snare wire member 17. In addition, the upper elastic member 16 needs to have a property that allows a striking impact to reach the first rigid member 21 of the dummy snare wire member 17. Thus, a hard sponge-like material is used for the upper elastic member 16 to limit impact absorption. The lower elastic member 18 is disposed between the dummy snare wire member 17 and the bottom of the pad body 14 so that the second rigid members 22 are bounced back by the lower elastic member 18 because of the elastic force of the lower elastic member 18. This allows the second rigid members 22 to easily strike the first rigid member 21. Further, the lower elastic member 18 needs to have a property that allows the second rigid members 22 to easily move vertically on the lower elastic member 18. Thus, a sponge-like material softer than the upper elastic member 16 is used for the lower elastic member 18.

The upper elastic member 16 and the lower elastic member 18 have the same shape and surface area as the batter surface member 11. A double-sided tape 19 is adhered to the central region of the lower elastic member 18. The central region of the lower elastic member 18 corresponds to the location where a sound resembling that of a snare wire is produced in the dummy snare wire member 17.

Figure 5:
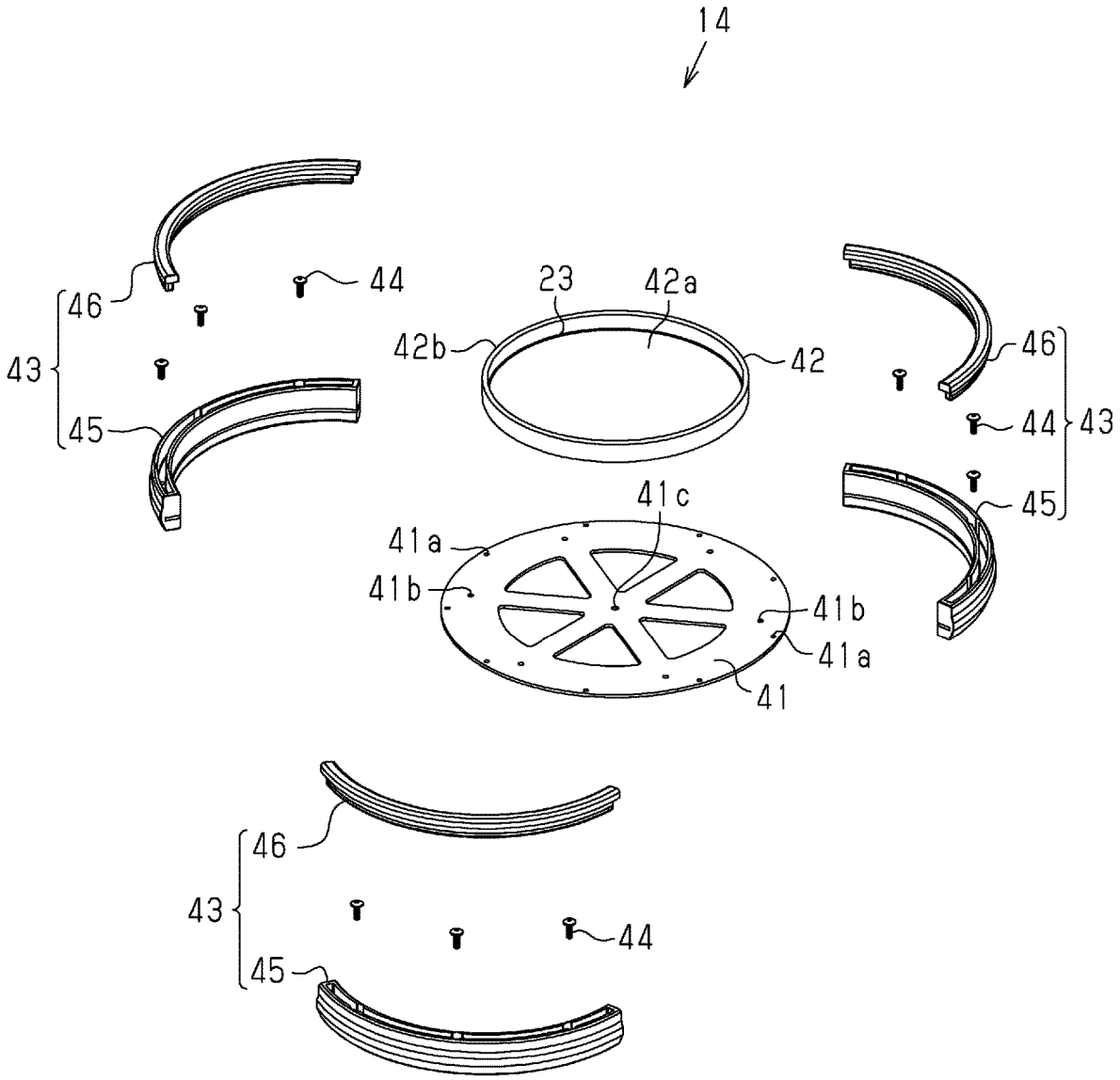
FIG. 5 is an exploded perspective view of a pad body.

As shown in FIGS. 4 and 5, the pad body 14 includes a base plate 41 and a shell 42. Three rim members 43 are attached to the pad body 14. The base plate 41 is substantially disc-shaped. The base plate 41 is formed by cutting out material from a circular steel plate. An outermost circumferential portion of the base plate 41 includes nine threaded holes 41*a* formed at equal angular intervals. Screws 44 are inserted into the threaded holes 41*a* to fasten the rim members 43 to the base plate 41.

An outer circumferential portion of the base plate 41 includes six bolt holes 41*b* formed at equal angular intervals and located inward from the threaded holes 41*a*. The bolts 13 are inserted into the bolt holes 41*b* to couple the batter surface member 11 to the pad body 14. The base plate 41 includes a through hole 41*c* in the central portion used to position the shell 42.

The shell 42 is cylindrical and includes a closed bottom end. The shell 42 includes a bottom plate portion 42*a* and a tubular portion 42*b* that is arranged around the circumference of the bottom plate portion 42*a*. The shell 42 is formed by molding a resin material such as nylon. The shell 42 includes a recess 23 that accommodates the dummy snare wire member 17, the upper elastic member 16, and the lower elastic member 18.

Figure 6:
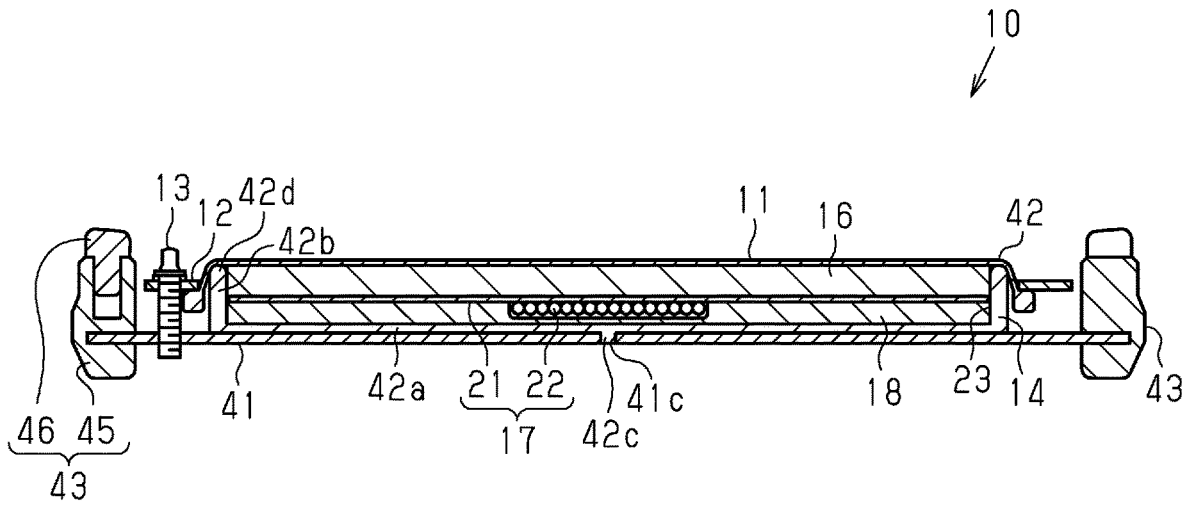
FIG. 6 is a cross-sectional view taken along line 6-6 in FIG. 3.
Figure 7:
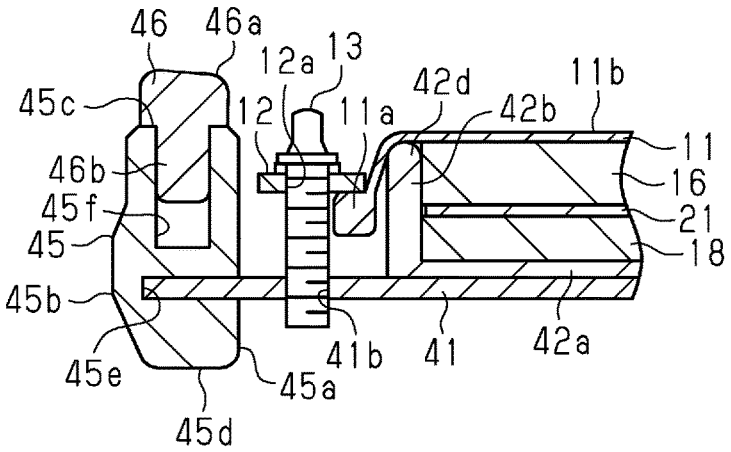
FIG. 7 is an enlarged cross-sectional view showing part of the snare pad near a bolt.

As shown in FIGS. 6 and 7, the bottom plate portion 42*a* forms the bottom part of the pad body 14. The bottom plate portion 42*a* includes a positioning boss 42*c* that is fitted in the through hole 41*c* of the base plate 41. The tubular portion

42*b* includes a distal end 42*d* that forms an open end of the shell 42, or the open end of the pad body 14. The distal end 42*d* of the tubular portion 42*b* has a semicircular cross section.

As shown in FIGS. 4 and 5, the three rim members 43 each have the same shape and structure. Each rim member 43 includes a rim body 45 and a cover 46 that is coupled to the rim body 45. The rim body 45 is formed by molding a resin material such as nylon. The rim body 45 and the cover 46 are elongated in an arching manner. The rim body 45 and the cover 46 have the same length.

As shown in FIGS. 6 and 7, a first fixing groove 45*e* is formed in an inner circumferential surface 45*a* of the rim body 45 and extends toward an outer circumferential surface 45*b* of the rim body 45. Further, a second fixing groove 45*f* is formed in an upper end surface 45*c* of the rim body 45 and extends to an intermediate position between the upper end surface 45*c* and a lower end surface 45*d* of the rim body 45. The rim body 45 is fixed to the outermost circumferential portion of the base plate 41 by inserting the circumference of the base plate 41 and fastening the base plate 41 to the first fixing groove 45*e* with the three screws 44 shown in FIG. 5.

Each cover 46 includes a surface portion 46*a* and a projection portion 46*b* that projects from the surface portion 46*a*. The cover 46 is formed from rubber. The surface portion 46*a* is inclined toward the inner circumference of the cover 46 to allow the stick ST to parallelly strike the surface portion 46*a* when performing an open rimshot, which strikes the drumhead 11*b* and the rim members 43 simultaneously. This impedes wear of the surface portion 46*a*. The cover 46 is attached to the upper surface of the rim body 45 by fitting the projection portion 46*b* into the second fixing groove 45*f*.

As shown in FIGS. 4 and 5, the three rim members 43 are each coupled to one of three equally divided parts of the outermost circumferential portion of the base plate 41. The three rim members 43 are coupled to the entire outer circumferential portion of the base plate 41 so as to form an annular member extending along the circumference of the base plate 41.

As shown in FIGS. 4, 6, and 7, the dummy snare wire member 17 is accommodated in the recess 23 of the shell 42 and sandwiched between the upper elastic member 16 and the lower elastic member 18. The dummy snare wire member 17 is configured to produce a sound resembling that of a snare wire as the second rigid members 22 repetitively move in and out of contact with the first rigid member 21.

The first rigid member 21 is formed from a metal such as stainless steel or aluminum alloy. The first rigid member 21 has the same shape and surface area as the batter surface member 11. In the central region of the dummy snare wire member 17 where a sound resembling that of a snare wire is produced, the first rigid member 21 is disposed between the upper elastic member 16 and the second rigid members 22.

The second rigid members 22 are formed by pellets having substantially equal diameters. The second rigid members 22 are formed from a metal such as stainless steel or aluminum alloy. The second rigid members 22 are laid out in a layer-like manner between the first rigid member 21 and the lower elastic member 18. The second rigid members 22 are arranged in a manner allowing for contact with the central region of the first rigid member 21. The second rigid members 22 are held by the double-sided tape 19 in the central region of the lower elastic member 18 so that the second rigid members 22 will not roll and scatter on the surface of the lower elastic member 18.

The batter surface member 11 is disposed on the tubular portion 42*b* of the shell 42 so that the frame 11*a* is located at an outer side of the open end of the pad body 14 and so that the drumhead 11*b* covers the open end of the pad body 14. The hoop 12 is fitted to the outer side of the open end of the pad body 14 in a state in which the inner circumference of the hoop 12 is in contact with the upper surface of the frame 11*a*. The six bolts 13 are inserted through the insertion holes 12*a* of the hoop 12 and fastened in the bolt holes 41*b* of the base plate 41 to couple the batter surface member 11 and the hoop 12 to the pad body 14.

In this manner, the batter surface member 11 is coupled to the open end of the pad body 14 in a state in which tension is applied to the drumhead 11*b*. Further, the shell 42 is pressed by the drumhead 11*b* and fixed to the surface of the base plate 41 in a state in which the boss 42*c* is fitted in the through hole 41*c* of the base plate 41. Here, the batter surface member 11 is coupled to the pad body 14 in a state in which the upper elastic member 16 formed from a sponge-like material is disposed between the batter surface member 11 and the dummy snare wire member 17. In other words, in a state in which the batter surface member 11 is coupled to the pad body 14, the pad body 14 is not located between the batter surface member 11 and the dummy snare wire member 17.

Further, the tension on the drumhead 11*b* is adjusted by adjusting the fastened amount of the bolts 13 in the bolt holes 41*b* and changing the fitted amount of the hoop 12 in the pad body 14. Specifically, the tension on the drumhead 11*b* is increased by lowering the position where the hoop 12 is fitted to the pad body 14. Further, the tension on the drumhead 11*b* is decreased by raising the position where the hoop 12 is fitted to the pad body 14. In this manner, the bolts 13 form a tension adjustment device that is configured to couple the batter surface member 11 to the pad body 14 while applying tension to the drumhead 11*b* and allow for adjustment of the tension on the drumhead 11*b*.

The operation of the snare pad 10 will now be described with reference to FIGS. 8A to 8C.

Figure 8A:
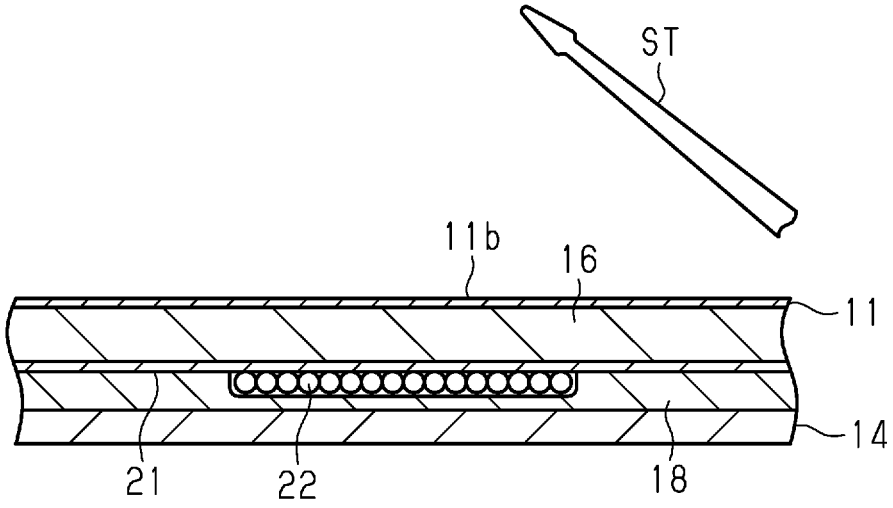
FIGS. 8A, 8B, and 8C are partially cross-sectional views illustrating the operation of the snare pad.

As shown in FIG. 8A, before the drumhead 11*b* is struck, the second rigid members 22 are disposed between the first rigid member 21 and the lower elastic member 18 in contact with the first rigid member 21.

Figure 8B:
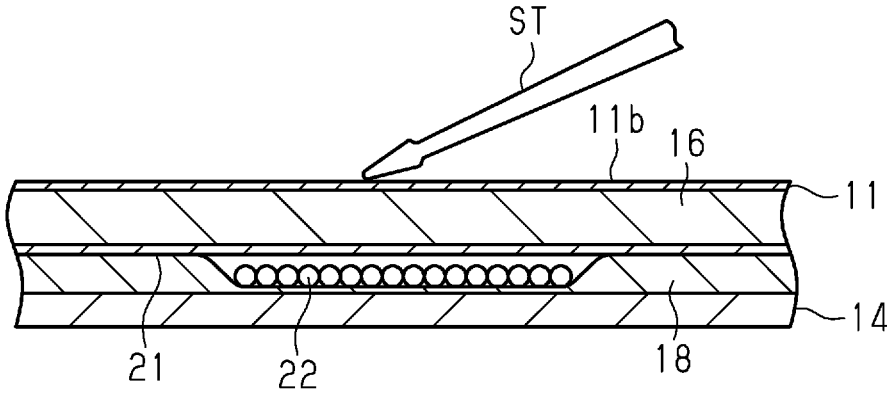

As shown in FIG. 8B, when the drumhead 11*b* is struck, the striking impact of the drumhead 11*b* simultaneously separates the second rigid members 22 from the first rigid member 21. Here, the pad body 14 is not located between the batter surface member 11 and the dummy snare wire member 17. Only the upper elastic member 16, which is formed from a sponge-like material, is located between the batter surface member 11 and the dummy snare wire member 17. Thus, the striking impact of the drumhead 11*b* is conveyed through the upper elastic member 16 without being weakened by the upper elastic member 16. In this manner, most of the striking impact reaches the first rigid members 21. The impact separates the second rigid members 22 from the first rigid member 21.

Figure 8C:
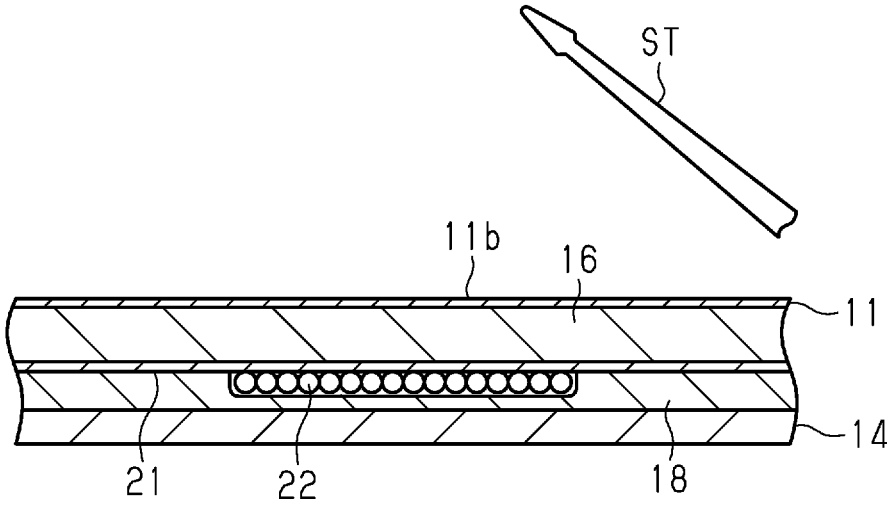

As shown in FIG. 8C, after being separated from the first rigid member 21, the second rigid members 22 are bounced back by the lower elastic member 18 because of the elastic force of the lower elastic member 18. Subsequently, the second rigid members 22, which are bounced back by the lower elastic member 18, strike the first rigid member 21. In this manner, the second rigid members 22 are separated from the first rigid member 21 by a striking impact and bounced back by the lower elastic member 18 to strike the first rigid member 21. Thus, the second rigid members 22 repetitively move in and out of contact with the first rigid member 21.

As a result, the second rigid members 22 and the first rigid member 21 produce a striking sound that resembles the sound of a snare wire.

The present embodiment has the following advantages.

(1) The batter surface member 11 is coupled to the pad body 14 without the pad body 14 being located between the batter surface member 11 and the dummy snare wire member 17. With this structure, the pad body 14 will not absorb the striking impact of the drumhead 11*b* before the impact from the batter surface member 11 reaches the dummy snare wire member 17. In this manner, the striking impact will not be weakened by the pad body 14 before reaching the dummy snare wire member 17. Thus, even when the batter surface member 11 is gently struck with the stick ST, the striking impact will reach the dummy snare wire member 17 and a low volume sound resembling that of a snare drum will be produced. Therefore, a sound resembling that of a snare drum is readily reproduced regardless of the striking strength.

Further, with this structure, a striking impact is not absorbed by the pad body 14. Thus, a sheet of a soft mesh material, which easily absorbs impacts, can be used for the drumhead 11*b* of the batter surface member 11. This provides a striking feel resembling that of an acoustic drum while ensuring quietness.

Also, mesh material sheets have superior flexibility and sound absorbency. Thus, when a mesh material is used for the drumhead 11*b*, the impact sound produced when striking the drumhead 11*b* will be absorbed effectively. This improves the quietness of the snare pad 10 and consequently increases the commercial product value of the snare pad 10.

(2) The bolts 13 form a tension adjustment device that is configured to couple the batter surface member 11 to the pad body 14, while applying tension to the drumhead 11*b*, and adjust the tension on the drumhead 11*b*. This structure allows the batter surface member 11 to be coupled to the pad body 14 in a state in which tension is applied to the drumhead 11*b* by the bolts 13. Thus, a user striking the drumhead 11*b* will experience a bouncing feel resulting from the tension on the drumhead 11*b*. The striking feel of the drumhead 11*b* resembles the feel when playing an acoustic drum. Further, the bolts 13 are used to adjust the tension on the drumhead 11*b*, which is coupled to the pad body 14. Thus, the bouncing strength resulting from the tension on the drumhead 11*b* is changeable and the striking feel of the drumhead 11*b* is adjustable.

(3) The tension on the drumhead 11*b* is adjusted by adjusting the fastened amount of the bolts 13 to the bolt holes 41*b* and changing the fitted amount of the hoop 12 in the pad body 14. With this structure, the tension on the drumhead 11*b* is adjusted by tightening or loosening the bolts 13 in the bolt holes 41*b*. Thus, a user can adjust the tension on the drumhead 11*b* in the same manner as when tuning an acoustic drum. This allows the snare pad 10 to be handled in the same manner as an acoustic drum.

(4) The first rigid member 21 is disc-shaped and has the same shape and surface area as the batter surface member 11. With this structure, the dummy snare wire member 17 can be disposed directly below the batter surface member 11 over the entire surface of the batter surface member 11. In this manner, regardless of whether the drumhead 11*b* is struck at the central region or near the outer circumference, the striking impact will be conveyed from the batter surface member 11 to the dummy snare wire member 17. Thus, a sound resembling that of a snare wire will be readily reproduced regardless of where the drumhead 11*b* is struck.

(5) The first rigid member 21 is disposed in the central region of the dummy snare wire member 17 where a sound resembling that of a snare wire is produced between the upper elastic member 16 and the second rigid members 22. In other words, the first rigid member 21 is disposed between the batter surface member 11 and the second rigid members 22. With this structure, a striking impact of the batter surface member 11 is received by the surface of the first rigid member 21 and conveyed to the second rigid members 22. This allows the striking impact to reach the dummy snare wire member 17 even when the batter surface member 11 is struck gently. Thus, a low volume sound resembling that of a snare wire is produced even when the batter surface member 11 is struck gently.

(6) The second rigid members 22 are pellets. This structure allows the sound produced when the second rigid members 22 come into contact with the first rigid member 21 to resemble the sound of a snare wire. Thus, a sound that is produced when the batter surface member 11 is struck resembles the sound of a snare wire that is produced when an acoustic drum is struck.

(7) The lower elastic member 18 is disposed between the dummy snare wire member 17 and the bottom part of the pad body 14. With this structure, the second rigid members 22 are separated from the first rigid member 21 by the striking impact of the drumhead 11*b*. After being separated from the first rigid member 21, the second rigid members 22 are bounced back because of the elastic force of the lower elastic member 18 and struck against the first rigid member 21. In this manner, the second rigid members 22 are separated from the first rigid member 21 and struck against the first rigid member 21 so as to repetitively move in and out of contact with the first rigid member 21. In this case, the elastic force of the lower elastic member 18 allows the second rigid members 22 to easily strike the first rigid member 21. This produces a clear sound resembling that of a snare wire.

(8) The upper elastic member 16 is disposed between the batter surface member 11 and the dummy snare wire member 17. With this structure, the upper elastic member 16 prevents the striking impact of the drumhead 11*b* from being directly applied to the dummy snare wire member 17. This effectively mutes the striking sound of the drumhead 11*b*, improves the quietness of the snare pad 10, and consequently increases the commercial product value.

(9) A typical snare drum employs a rim member that is integrated with the hoop. In this case, when the fitted amount of the hoop on the open end of the pad body is changed to adjust the tension on the drumhead, the height of the rim member will be changed together with the height of the hoop. In contrast, a snare drum practice pad employs a drumhead formed from a soft material to improve quietness. A soft drumhead stretches more easily than a drumhead formed from a hard material and the tension on the drumhead is apt to decrease Thus, when a soft drumhead is employed, the hoop needs to be adjusted by a greater fitting amount to increase the tension on the drumhead than when a hard drumhead is employed.

Further, the snare drum practice pad may be used to practice an open rimshot in which the drumhead and the rim member are struck simultaneously. For example, with a snare drum practice pad that employs a rim member integrated with the hoop, when the fitted amount of the hoop is adjusted to change the tension on the drumhead, the height of the rim member will be changed together with the height the hoop. This will change the height of the rim member relative to the height of the batter surface. Further, when the snare drum practice pad employs a drumhead formed from a soft material, a relatively large amount of the hoop is adjusted to change the fitted amount of the hoop. Thus, the height of the rim member will be changed by a greater amount relative to the height of the batter surface. This changes the feel of the open rimshot and the user may experience an awkward feeling.

In this respect, in accordance with the present disclosure, the pad body 14 includes the rim members 43, which are separate from the hoop 12. This structure allows the height of the rim members 43 to be set without being affected by the height of the hoop 12. Accordingly, when the fitted amount of the hoop 12 is adjusted to change the tension on the drumhead 11*b*, the height of the hoop 12 will be changed while the height of the rim members 43 remains fixed. When the height of the rim members 43 is fixed relative to the height of the batter surface, the feel of the open rimshot will remain the same and the user will not experience the awkward feeling. Therefore, even when the snare pad 10 employs the drumhead 11*b* formed from a soft mesh material, the height of the rim members 43 is fixed relative to the height of the batter surface. This allows a user to practice an open rimshot without experiencing the awkward feeling.

(10) Each rim member 43 includes the rim body 45 and the cover 46. With this structure, the cover 46, which is formed from rubber and struck by the stick ST, is arranged on the upper surface of the rim member 43. Thus, the stick ST will not directly contact the rim members 43. This further improves the quietness of the snare pad 10 and consequently increases the commercial product value.

The present embodiment may be modified as follows.

The upper elastic member 16 disposed between the batter surface member 11 and the dummy snare wire member 17 may be omitted. Further, instead of the upper elastic member 16 that is formed from a sponge-like material, the upper elastic member 16 may be formed from, for example, an elastic material other than a sponge-like material such as urethane, felt, glass wool, or rubber.

The snare pad 10 does not have to include a structure for adjusting the tension on the drumhead 11*b* with the bolts 13. For example, the batter surface member 11 may be fixed directly to the open end of the pad body 14 without the hoop 12. Further, instead of the drumhead 11*b*, a pad formed by a rubber sheet may be fixed directly to the open end of the pad body 14.

The structure configured to adjust the tension on the drumhead 11*b* with the bolts 13 may be modified as follows. For example, the hoop 12 may be omitted, and the frame 11*a* of the batter surface member 11 may include six through holes for the bolts 13. In this case, the tension on the drumhead 11*b* is adjusted by adjusting the fastened amount of the bolts 13 in the bolt holes 41*b* and changing the amount of the frame 11*a* fitted in the pad body 14.

The first rigid member 21 does not have to be disc-shaped and have the same shape and surface area as the batter surface member 11. Instead, as long as the first rigid member 21 mostly overlaps the batter surface member 11 in a projected view, the first rigid member 21 may be, for example, elliptic or have the shape of a polygon such as an octagon. Further, the first rigid member 21 does not have to be formed from a metal such as stainless steel or aluminum alloy and may be formed from, for example, a rigid material other than metal such as a ceramic or a plastic.

Instead of pellets, wire-like material such as steel wool or glass fiber may be used for the second rigid members 22. Further, the second rigid members 22 do not have to be formed from a metal such as stainless steel or aluminum alloy. As long as the material is rigid, the second rigid members 22 may be formed from, for example, a material other than metal such as a ceramic or a plastic.

Instead of a sponge-like material, for example, an elastic material other than a sponge-like material such as urethane, felt, glass wool, or rubber, may be used for the lower elastic member 18 disposed between the dummy snare wire member 17 and the bottom part of the pad body 14.

Each rim member 43 does not have to be one of three segments dividing an annular member, which extends along the outer circumference of the pad body 14, at equal angular intervals. The annular member may be divided into any number of segments in correspondence with the design and specification of the snare pad 10.

The rim members 43 do not have to be attached to the entire outer circumferential portion of the pad body 14 and may be attached to part of the outer circumferential portion of the pad body 14.

The rim members 43 do not have to be attached to the pad body 14. As long as the hoop 12 is a separate member, the rim members 43 may be, for example, formed integrally with the base plate 41 of the pad body 14.

Each rim member 43 does not have to include the rim body 45 and the cover 46 and may include only the rim body 45.

Instead of a sheet of mesh material, for example, a sheet of leather or plastic may be used for the drumhead 11*b*.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A snare drum practice pad, comprising:

a pad body;

a batter surface member coupled to the pad body; and a dummy snare wire member arranged in the pad body to produce a sound resembling that of a snare wire when the batter surface member is struck, wherein the dummy snare wire member includes a first rigid member and a second rigid member that is arranged in a manner allowing for contact with the first rigid member, the dummy snare wire member is configured to produce the sound resembling that of the snare wire when the first rigid member and the second rigid member repetitively move in and out of contact with each other, and the batter surface member is coupled to the pad body without the pad body being located between the batter surface member and the dummy snare wire member.

2. The snare drum practice pad according to claim 1, wherein the batter surface member includes a drumhead that produces a striking feel resembling that of a snare drum, and the snare drum practice pad further comprises:

a tension adjustment device that couples the batter surface member to the pad body while applying tension to the drumhead and is configured to allow for adjustment of the tension on the drumhead.

3. The snare drum practice pad according to claim 2, wherein the pad body includes an open end, the pad body includes a bolt hole at a location where the batter surface member is coupled, the tension adjustment device includes a bolt that is inserted into the bolt hole, the batter surface member is coupled to the open end of the pad body by a hoop that is fitted to an outer circumference of the open end, and the tension adjustment device is configured to adjust the tension on the drumhead by adjusting a fastened amount of the bolt to the bolt hole and changing a fitted amount of the hoop on the pad body.

4. The snare drum practice pad according to claim 2, wherein the drumhead is formed from a mesh material.

5. The snare drum practice pad according to claim 1, wherein the first rigid member has a plate-like shape, and the first rigid member and the battery surface member have the same shape and surface area.

6. The snare drum practice pad according to claim 5, wherein the first rigid member is disposed between the batter surface member and the second rigid member.

7. The snare drum practice pad according to claim 1, wherein the second rigid member is wire-like or pellet-like.

8. The snare drum practice pad according to claim 1, further comprising:

a lower elastic member disposed between the dummy snare wire member and a bottom part of the pad body.

9. The snare drum practice pad according to claim 1, further comprising:

an upper elastic member disposed between the batter surface member and the dummy snare wire member.

10. A snare drum practice pad, comprising:

a pad body including an open end;

a hoop fitted to an outer circumference of the open end;

a batter surface member coupled to the open end by the hoop and including a drumhead that produces a striking feeling resembling that of a snare drum when the batter surface member is struck; and a rim member arranged on the pad body and extending along an outer circumference of the pad body, wherein the rim member is separate from the hoop.

11. The snare drum practice pad according to claim 10, wherein a cover is attached to an upper surface of the rim member.

12. The snare drum practice pad according to claim 10, wherein the drumhead is formed from a mesh material.

* * * * *